US007726245B2

(12) United States Patent
Quesenberry et al.

(10) Patent No.: US 7,726,245 B2
(45) Date of Patent: Jun. 1, 2010

(54) MUZZLELOADER AMMUNITION

(75) Inventors: Richard Quesenberry, Wilis, VA (US); Jeffrey Bandel, Radford, VA (US); Drew Lee Goodlin, Isanti, MN (US); William J. Worrell, Draper, VA (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

(21) Appl. No.: 12/109,472

(22) Filed: Apr. 25, 2008

(65) Prior Publication Data

US 2009/0266263 A1 Oct. 29, 2009

(51) Int. Cl.
*F42B 5/18* (2006.01)
*F41C 9/08* (2006.01)

(52) U.S. Cl. ..... 102/432; 42/51

(58) Field of Classification Search ..... 102/431, 102/432, 433, 502; 42/51
See application file for complete search history.

(56) References Cited

U.S. PATENT DOCUMENTS

| | | | | | |
|---|---|---|---|---|---|
| 35,699 | A | | 6/1862 | Mayberry | |
| 1,528,101 | A | * | 3/1925 | Davison et al. | 102/431 |
| 2,424,934 | A | * | 7/1947 | Kasper | 102/380 |
| 3,098,444 | A | * | 7/1963 | Walkey et al. | 102/464 |
| 3,164,092 | A | * | 1/1965 | Reed et al. | 102/522 |
| 3,212,440 | A | * | 10/1965 | Quinlan et al. | 102/431 |
| 3,311,057 | A | * | 3/1967 | Quinlan et al. | 102/431 |
| 3,336,871 | A | * | 8/1967 | Quinlan | 102/431 |
| 3,348,445 | A | | 10/1967 | Nadel | |
| 3,396,658 | A | * | 8/1968 | Scanlon Jr. et al. | 102/431 |
| 3,482,516 | A | * | 12/1969 | Ruth et al. | 102/433 |
| 3,598,052 | A | * | 8/1971 | Schwartz et al. | 102/431 |
| 3,658,008 | A | * | 4/1972 | Larson | 102/431 |
| 3,732,819 | A | * | 5/1973 | Quinlan et al. | 102/433 |
| 3,901,153 | A | | 8/1975 | Brabets et al. | |
| 3,987,731 | A | | 10/1976 | Brzuskiewicz | |
| 4,356,769 | A | * | 11/1982 | Galluzzi | 102/380 |
| 4,572,076 | A | * | 2/1986 | Politzer et al. | 102/431 |
| 4,709,636 | A | | 12/1987 | Mueller et al. | |
| 4,759,885 | A | | 7/1988 | Kurtz | |
| 5,323,707 | A | | 6/1994 | Norton et al. | |

(Continued)

OTHER PUBLICATIONS

"Identification of Ascorbic Acid and Its Degradation Products in Black Powder Substitutes" by John V. Goodpaster, and Raymond Keto. J. Forensic Sci. May 2004, Vo. 49, No. 3, 2004, pp. 523-528.

*Primary Examiner*—Bret Hayes
(74) *Attorney, Agent, or Firm*—Vidas, Arrett & Steinkraus, P.A.

(57) ABSTRACT

A fixed round of ammunition for a muzzle loader firearm. The round has a bullet within a sabot that is engaged to a consumable cartridge case. The case is filled with propellant that is precisely calibrated to provide optimal ballistic properties with the particular bullet it is engaged to. The consumable cartridge case can be more tailored to respectively increase or decrease the burn rate of the consumable cartridge case. The consumable cartridge case can be constructed out of nitrocellulose or other energetic materials. A wide range of propellant formulas can be used that are safe because the burn rate is precisely calibrated for the bullet used. The propellant can contain pyrotechnic material and/or other ingredients to reduce the burn rate of a smokeless propellant and can contain a stabilizer to increase the shelf life of the ammunition round.

16 Claims, 3 Drawing Sheets

U.S. PATENT DOCUMENTS

| | | | | |
|---|---|---|---|---|
| 5,449,423 | A | 9/1995 | Cioffe | |
| 5,557,151 | A | 9/1996 | Epstein et al. | |
| 5,633,476 | A | 5/1997 | Cioffe | |
| 5,726,378 | A * | 3/1998 | Barrett | 102/288 |
| 6,012,394 | A * | 1/2000 | Dion et al. | 102/443 |
| 6,334,394 | B1 | 1/2002 | Zimmermann et al. | |
| 6,405,654 | B1 | 6/2002 | Smith | |
| 6,688,232 | B2 | 2/2004 | Griesbach et al. | |
| 6,877,415 | B2 | 4/2005 | Griesbach et al. | |
| 7,059,074 | B1 | 6/2006 | Calvete Zumalde | |
| 7,137,218 | B1 * | 11/2006 | Adkins, Jr. | 42/51 |
| 2004/0144457 | A1 | 7/2004 | Barrett et al. | |
| 2006/0011086 | A1 | 1/2006 | Rose et al. | |
| 2006/0169164 | A1 | 8/2006 | Brus | |
| 2006/0230971 | A1 * | 10/2006 | Harrison | 102/374 |

* cited by examiner

MUZZLELOADER AMMUNITION

CROSS-REFERENCE TO RELATED APPLICATIONS

Not Applicable

STATEMENT REGARDING FEDERALLY SPONSORED RESEARCH

Not Applicable

FIELD OF THE INVENTION

In some embodiments this invention relates to ammunition for muzzle-loader guns, and more particularly to muzzle-loader ammunition having a consumable cartridge case. Some embodiments are directed to the manufacture, and methods of use of such devices.

BACKGROUND OF THE INVENTION

Description of the Related Art

Various forms of ammunition have been proposed for muzzle loading ammunition. Such ammunition over the years evolved from round ball projectiles to ammunition that has incorporated many of the features of modern bullets. Current muzzle loading ammunition however comprise multiple parts which are combined together when loaded into a firearm. Because the various parts are separate, they are not sealed and furthermore they use pyrotechnic materials which tend to be hygroscopic (they tend to absorb moisture from their surroundings and in particular absorb water vapor from the atmosphere). As a result, their efficiency degrades over time and the propellant and resultant combustion products tend to corrode the firearm barrel and chamber. No previous muzzle loading ammunition however has featured a consumable case used to hold the ammunition components together and thus protect the propellant from moisture absorption.

Without limiting the scope of the invention a brief summary of some of the claimed embodiments of the invention is set forth below. Additional details of the summarized embodiments of the invention and/or additional embodiments of the invention may be found in the Detailed Description of the Invention below.

BRIEF SUMMARY OF THE INVENTION

This invention contemplates a number of embodiments where any one, any combination of some, or all of the embodiments can be incorporated into muzzle loaded ammunition. In addition, this invention contemplates a number of embodiments where any one, any combination of some, or all of the embodiments can be incorporated into a method of using such muzzle loaded ammunition.

At least one embodiment of the present invention is directed to a muzzle loaded ammunition round comprising a bullet and a cartridge case. The round is a fixed round. The cartridge case is hollow and is filled with at least one propellant composition. The bullet is commonly engaged to the propellant composition at least via the cartridge case. When the bullet is fired, the energy with which the bullet exits the firearm is a ratio proportional at least to the burn rate, the charge weight, and at least one physical property of the bullet. The burn rate is proportional to the combustibility of both the propellant and the cartridge case. The burn rate and at least one physical property of the bullet are precisely calibrated to each other so as to yield ballistic properties in which the bullet is fired with a desired amount of kinetic energy and within the design constraints of the firearm.

At least one embodiment of the present invention is directed to a muzzle loaded ammunition round in which the cartridge case is constructed out of a consumable material. The consumable material can be energetic. One of the calibrated physical properties of the bullet is one selected from the group consisting of: size, mass, density, caliber, shape, and any combination thereof. The burn rate can be controlled by modifying the density of the consumable material of the cartridge case. The cartridge case can be constructed at least in part out of nitrocellulose.

At least one embodiment of the present invention is directed to a muzzle loaded ammunition round in which the bullet is positioned within a sabot and the sabot is engaged to the cartridge case. The sabot can be constructed at least in part out of a thermoplastic material. At least one of the calibrated physical properties of the bullet is separability from the sabot.

At least one embodiment of the present invention is directed to a muzzle loaded ammunition round constructed and arranged to be penetrated by a breech block. At least one embodiment of the present invention is directed to a muzzle loaded ammunition round further comprising an electrically conductive probe extending into the end of the cartridge case not facing the bullet.

At least one embodiment of the present invention is directed to a muzzle loaded ammunition round in which the propellant composition is one selected from the list consisting of: smokeless propellant, single base nitrocellulose, nitrocellulose propellant, black powder propellant, pyrotechnic propellant, non-pyrotechnic propellant, and any combination thereof. The propellant composition can occupy a volume substantially equal to at least 90% of the volume of the cartridge case. The propellant composition can include at least one energy modifying material. The at least one energy modifying material can be an energy reducing material. The propellant composition can also include a pyrotechnic material or a stabilizer compound. The stabilizer compound can be 1% or less by volume of the propellant composition.

BRIEF DESCRIPTION OF THE SEVERAL VIEWS OF THE DRAWINGS

The invention is best understood from the following detailed description when read in connection with accompanying drawings, in which.

DETAILED DESCRIPTION OF THE INVENTION

Figure 1:
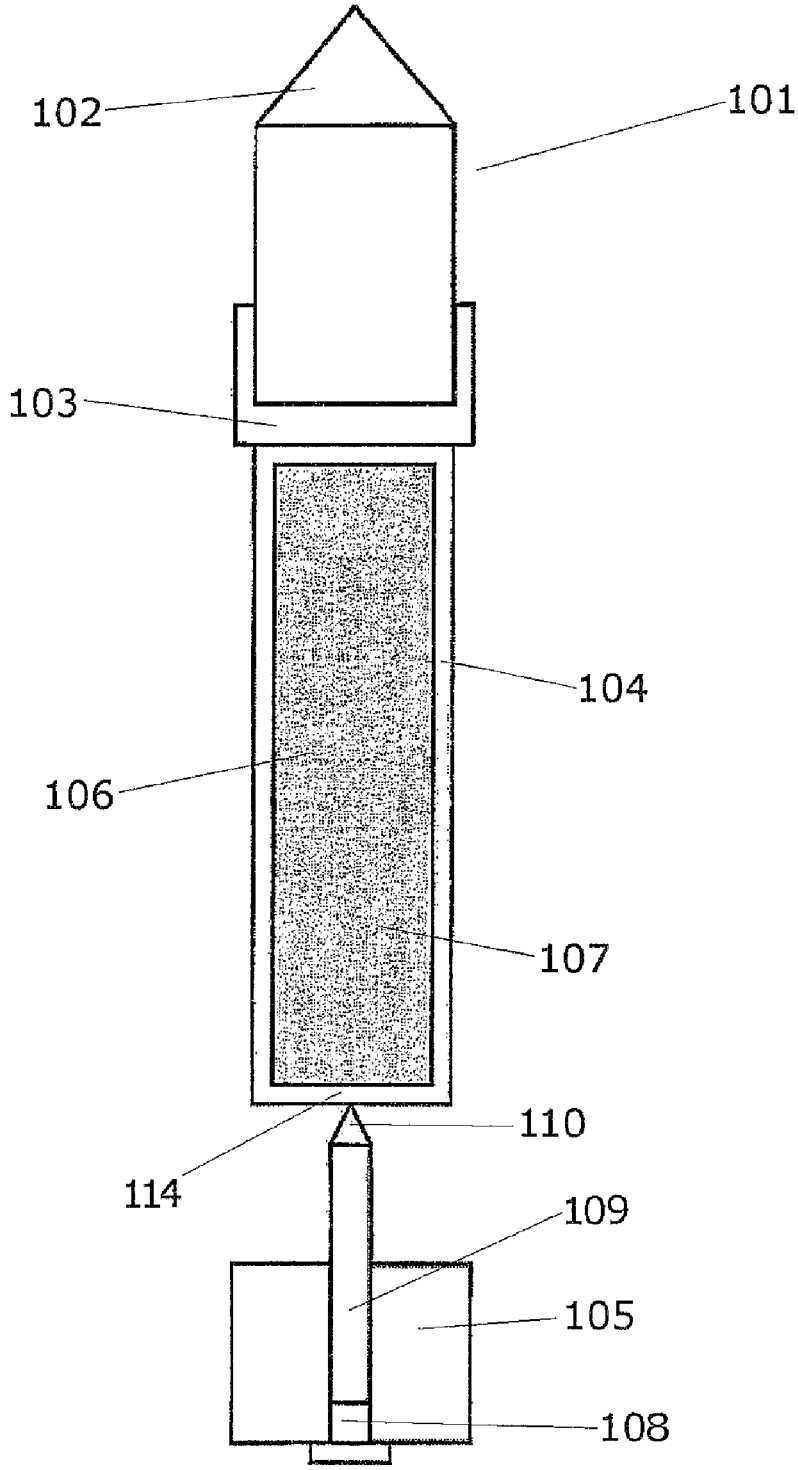
FIG. 1 is a lateral view of a round of improved muzzle loaded ammunition.

The invention will next be illustrated with reference to the figures wherein the same second (tens) and third (ones) digits of numbers indicate similar elements in all figures. Such figures are intended to be illustrative rather than limiting and are included herewith to facilitate the explanation of the apparatus of the present invention. For the purposes of this disclosure, like second (tens) and third (ones) digits of the reference numerals in the figures shall refer to like features unless otherwise indicated. Depicted in the figures are various aspects of the invention. Elements depicted in one figure may be combined with, or substituted for, elements depicted in another figure as desired.

Referring now to FIG. 1 there is shown an embodiment of the invention featuring a muzzle loaded ammunition round (101) having a bullet (102) at its front end held in place by sabot (103) which in turn is engaged to a cartridge case (104). For purposes of this application, the definition of the term "bullet" is a projectile missile fired by a firearm intended and designed for the purpose of striking a target. Bullets include saboted bullets, full bore non-saboted bullets, and shotgun shot. Bullets do not include sabot, wads, propellant, cartridge cases, compressed gas, or any other material ejected from the barrel of a fired firearm other than the projectile missile intended and designed to strike a target.

The cartridge case (104) is generally cylindrical in shape and includes an internal lumen (106). A propellant (107) is contained within the lumen (106) of the cartridge case (104). Ignition of the propellant (107) provides the energy that propels the saboted bullet (102) at a target. The propellant can be legacy black powder, substitute pyrotechnic propellant, as well as smokeless propellant and/or nitrocellulose propellant.

The round (101) is a fixed round. For purposes of this application the definition of the term "fixed round" is a round of ammunition which when stored outside of the firearm chamber prior to loading the round, has the propellant and the bullet commonly engaged to each other via direct engagement or via one or more other components of the round. For purposes of this application the definition of the term "commonly engaged" means two linked items that are either directly engaged to each other or are each engaged to one or more linking items, each linking item in turn is linked to either another linking item or to one or both of the linked items. Prior Art muzzle loaded ammunition are not fixed rounds and the propellant (107) and bullet (102) are free of any common or shared engagements prior to being loaded into a firearm and can be stored separately.

In at least one embodiment the sabot (103) is constructed out of thermoplastic or other materials which provides mechanical means to obturate and launch the bullet (102). For purposes of this application the definition of the word "obturate" is to seal a bullet in a relative position or location. In at least one embodiment, the sabot (103) is engaged to the cartridge case (104) at the rear of the sabot (103). Other contemplated embodiments include a cartridge case (104) which extends around at least a portion of the sabot (103) and/or the bullet (102), and a non-sabot based bullet (102) with a diameter equal to that of the cartridge case (104). In at least one embodiment, the cartridge case (104) itself functions as a sabot and holds the bullet (102) in place. The sabot (103) and the bullet (102) can be calibrated to have the optimal separation properties for the desired ballistic effect. In at least one embodiment, the bullet (102) is a full-diameter bullet which does not utilize a sabot.

In at least one embodiment, the cartridge case (104) is constructed at least in part out of a consumable material. In at least one embodiment consumable material is highly energetic. Examples of such material are described in U.S. Pat. Nos. 5,323,707, 4,759,885 and 3,901,153 and published US patent application 2006/0169164 all of whose contents are hereby incorporated by reference in their entirety. In at least one embodiment the consumable cartridge case (104) is constructed out of nitrocellulose. Modifying the density of the consumable cartridge case material can modify its burn rate. Lower density consumable materials have a higher burn rate than higher density consumable materials.

In at least one embodiment, the consumable material is felted and or molded. When felted the consumable material is formed out of slurry which is shaped around a mandrel with heat and pressure. The density of the consumable cartridge case material can be calibrated (tailored) by felting. In at least one embodiment the consumable cartridge case material has a low density yet has appropriate support strength.

As illustrated in FIG. 1, in at least one embodiment, the ammunition (101) is constructed and arranged with its rear portion positioned facing a breech block part of the muzzle loading firearm (105) when loaded into a firearm. In at least one embodiment, the ammunition (101) is constructed and arranged to be used in combination with a primer (108) or igniter separately positioned within a firearm barrel. When the firearm is triggered, a hammer strikes the primer material (108) igniting it, the breech block (105) penetrates the cartridge case (104) with a probe (109) or bayonet having a sharp point (110) that forms a hole which allows hot materials from the ignited primer (108) to enter the rear portion (114) of the cartridge case (104) and ignite the propellant (107). As shown in FIG. 1, the probe (109) can be tubular with a conical tip, can be conical, can be serrated, or can be any combination thereof, or can be of any shape known in the art.

Figure 2:
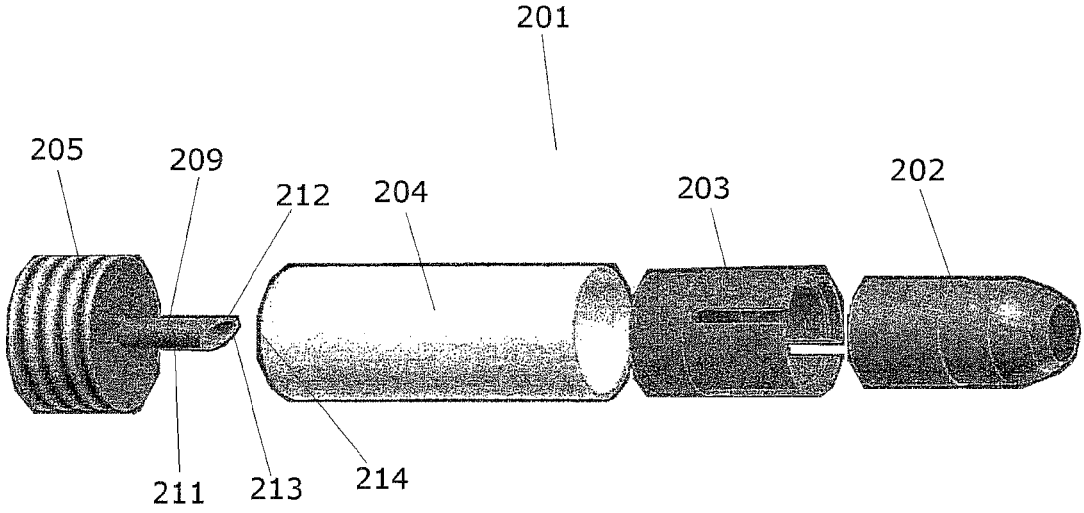
FIG. 2 is a perspective view of parts in a round of improved muzzle loaded ammunition.

FIG. 2 illustrates the parts of an ammunition round (201) in which the bullet (202), sabot (203), cartridge case (204), lumen (206), and propellant (207) are constructed and arranged to work with a spitter-type breech block (205). The probe (209) of the spitter-type breech block (205) comprises a tube (211) with a sharpened end (213) which penetrates the cartridge case (204). After penetration, hot materials from the ignited primer travel through the interior (212) of the tube (211) into a region of the lumen (206) significantly distant from the rear portion (214) of the cartridge case (204). The length of the tube (211) and/or the cartridge case (204) can be adjusted to insert the hot primer materials into a specific depth of the cartridge case (204) which will impart optimal ballistic properties to the round (201). Although FIG. 2 illustrates the tube (211) having a sharpened end (213) sharpened with an oblique slope formed out of the front most tip of the tube wall, the inventive concept contemplates other sharpening arrangements including but not limited to pointed tips, triangular tips, conical tips, conical tubes, and any combination thereof. In at least one embodiment, the probe (209) penetrates the cartridge case (204) prior to firing and holds the round (201) in place until the round (201) is fired.

Figure 3:
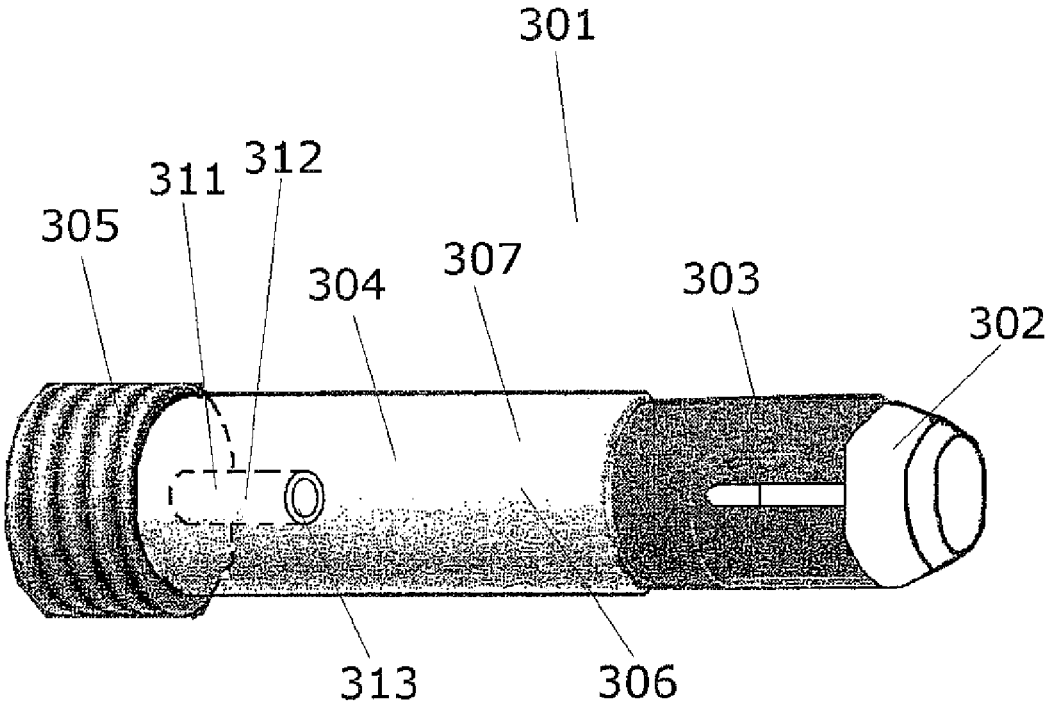
FIG. 3 is a perspective view of a round of improved muzzle loaded ammunition comprising a breech block.

FIG. 3 illustrates an embodiment in which the breech block (305) is a component of the round (301) itself and has a member (311) extending within the cartridge case (304) prior to firing the round (301). In at least one embodiment the member (311) is a tube having an interior (312) with an open top (313) facing the lumen (306) of the cartridge case (304). In at least one embodiment the exterior surface of the tube is in contact with propellant (307). In at least one embodiment the interior surface of the tube (312) is in contact with or is filled with propellant (307). In at least one embodiment the tube (311) is constructed and arranged to ignite the propellant (307) with an electric pulse that is delivered to the cartridge lumen (306). In at least one embodiment the tube (311) is constructed and arranged to ignite the propellant (307) with an electric charge that is delivered to propellant (307) within the tube (311). In at least one embodiment the tube (311) is constructed out of a conductive material. In at least one embodiment the tube (311) comprises one or more veins of conductive material integrated into the tube walls. In at least one embodiment, the round is constructed and arranged to cooperatively work with the firearm electronic ignition system described in U.S. Pat. No. 7,197,843 all of whose contents are hereby incorporated by reference in its entirety.

Referring again to FIG. 1 there is shown that in at least one embodiment, the propellant (107) is a non-pyrotechnic propellant such as smokeless propellant and/or nitrocellulose based propellant. In prior art muzzle loading ammunition, because at least some of the firing components were individually loaded into the firearm they could vary. This made it unsafe to use non-pyrotechnic propellants. Non-pyrotechnic propellants are highly energetic when used within the high pressure environment of a firearm barrel or chamber in the process of firing a projectile. Such highly energetic propellants when used in the incorrect quantity relative to the specific ballistic pressure of a given bullet in a given firearm can result in unwanted or excessive pressure. As a result, in the prior art the burn rate of the propellant was made safe by using pyrotechnic propellants which utilize a combination of finely powdered fuel (such as black powder) and oxidant, with or without additives to reduce the burn rate/energy output of a given propellant charge weight.

In the instant invention, because the ammunition is a fixed round, and the bullet is held by the cartridge case, the ratio of charge weight to bullet mass is under control of the manufacturer and will not vary after it is assembled. As a result by properly calibrating the charge weight to the bullet mass more powerful non-pyrotechnic propellants can be safely used. In at least one embodiment, the optimal quantity of non-pyrotechnic propellant charge weight relative to the weight needed for ballistic properties of a given bullet can be precisely determined and a cartridge case including that exact charge weight is fixedly engaged (with or without a sabot) to the given bullet. The round can have a charge weight that is exactly calibrated with particular bullets based on the bullet's size, mass, density, caliber, shape, or any other physical attribute and any combination thereof. This allows firearms to utilize the benefits of smokeless powder including reduced corrosion, very low hygroscopicity, and less or no need for cleaning the firearm. In at least one embodiment the propellant is black powder or substitute pyrotechnic propellant. In at least one embodiment the black powder or substitute pyrotechnic propellant are calibrated for optimum ballistic properties. Examples of such a substitute pyrotechnic propellant is described in U.S. Pat. No. 4,128,443 whose contents are hereby incorporated by reference in its entirety. In at least one embodiment the volume, length, or diameter, of either the cartridge case or the propellant within the cartridge case, or the grains of powder in the propellant, or any combination have the same dimensions or grains of powder described in U.S. Pat. No. 5,726,378 whose contents are hereby incorporated by reference in its entirety.

In at least one embodiment the geometry of the ammunition is calibrated for optimal ballistic effect. Because the manufacturer has complete control over the assembly of all of the components in fixed ammunition, the manufacturer can calibrate such properties as the density of charge, the load density, the area and shape of an inhibited propellant (in which a portion of the surface area has been treated to control or prevent burning), and/or the column length (length of the propellant and/or pyrotechnic composition). In at least one embodiment, the round's geometry is calibrated to allow the propellant to occupy 90% of the volume the cartridge case. In at least one embodiment the ammunition as a whole is sized to be easily fit within the firearm. In at least one embodiment the felting of the consumable cartridge casing is calibrated to set the porosity to a degree that it facilitates optimal ballistic effect. Porosity can be increased to increase burn rate or decreased to decrease burn rate. In at least one embodiment, the ballistic performance of the round matches that described in described in U.S. Pat. No. 5,726,378 whose contents are hereby incorporated by reference in its entirety.

In at least one embodiment the composition of the consumable cartridge case and/or the propellant are calibrated to produce the optimal burn rates for firing a given caliber bullet. In at least one embodiment, the granulation of a propellant charge weight is calibrated to produce the optimal burn rates for firing a given caliber bullet. In at least one embodiment, the stoichiometric ratios of the various compositions in the consumable cartridge case and/or the propellant, are balanced to provide the optimal propellant charge. These ratios can include black powder propellants, non-pyrotechnic propellants, and any combination thereof.

In at least one embodiment a propellant based on nitrocellulose is used. In at least one embodiment the nitrocellulose is single base (it is the only explosively energetic component in the propellant) and its mass and concentration are balanced for optimal ballistic effect. Even though single base nitrocellulose is three times as energetic as black powder it can be safely used in combination with the optimal amount of energy reducing materials and with carefully controlled charge weights. These energy reducing materials include but are not limited to: inert plasticizers, inert solids, inorganic potassium salts, granular polymeric materials, and any combination thereof. Examples of energy reducing granular polymeric materials include but are not limited to polyvinyl alcohols, polyesters, other aliphatic materials, other aromatic materials and any combination thereof.

In at least one embodiment, mixed in with the propellant is a pyrotechnic material. Such a pyrotechnic material makes smoke, reduces the energy of the combusting propellant, and is less susceptible to excessive burning rates in the high pressure environment of the firearm barrel. The pyrotechnic material is used to calibrate the burn rate to the optimal level by reducing the energy of the propellant. In at least one embodiment the pyrotechnic material is a weak oxidizing agent. In at least one embodiment, the pyrotechnic material is $KNO_3$. In at least one embodiment, the pyrotechnic material is used to produce visible smoke that makes firing the round appear more dramatic.

In at least one embodiment, mixed in with the propellant is a stabilizer. A stabilizer is a compound which reacts with the $NO_X$ radicals which naturally evolve out of nitrocellulose propellants. In at least one embodiment, the stabilizer is less than or equal to 1% of the volume or mass of the propellant. The stabilizer prevents degradation of the propellant assuring that the calibrated ballistic properties are retained over time. The stabilized propellant combined with the non-hygroscopic cartridge case results in a highly rugged ammunition round with a long shelf life.

While several embodiments in accordance with the present invention have been shown and described, it is understood that the same is not limited thereto but is susceptible to numerous modifications as known to one skilled in the art and applicant(s) therefore, do not wish to be limited to the details described herein but intend to cover all such modifications as are encompassed by the scope of the appended claims.

This completes the description of the preferred and alternate embodiments of the invention. The above disclosure is intended to be illustrative and not exhaustive. This description will suggest many variations and alternatives to one of ordinary skill in this art. The various elements shown in the individual figures and described above may be combined, substituted, or modified for combination as desired. All these alternatives and variations are intended to be included within the scope of the claims where the term "comprising" means "including, but not limited to".

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claims below.

What is claimed is:

1. A muzzle loaded ammunition round in combination with a firearm, comprising:

a fixed round comprising a bullet and a cartridge case;

the cartridge case is hollow and is filled with at least one propellant composition, the cartridge case being constructed out of an energetic consumable material, and having a burn rate which can be selected by selecting the density of the consumable material of the cartridge case;

the bullet is commonly engaged to the propellant composition at least via the cartridge case, the propellant composition having a charge weight;

an igniter which extends into the propellant composition inside the case at the time of ignition;

when the bullet is fired, an energy with which the bullet exits the firearm is a ratio proportional at least to the burn rate of the consumable cartridge case, the charge weight of the propellant composition, and at least one physical property of the bullet, the burn rate being proportional to the combustibility of both the propellant and the consumable cartridge case;

the burn rate and the at least one physical property of the bullet are precisely calibrated to each other so as to yield ballistic properties in which the bullet is fired with a desired amount of kinetic energy and within the design constraints of the firearm.

2. The muzzle loaded ammunition round of claim 1 in which the cartridge case is constructed out of a consumable material.

3. The muzzle loaded ammunition round of claim 1 in which a calibrated physical property of the bullet is one selected from the group consisting of: size, mass, density, caliber, shape, and any combination thereof.

4. The muzzle loaded ammunition round of claim 1 in which the cartridge case is at least in part constructed out of nitrocellulose.

5. The muzzle loaded ammunition round of claim 4 in which the sabot is constructed at least in part out of a thermoplastic material.

6. The muzzle loaded ammunition round of claim 4 in which at least one of the calibrated physical properties of the bullet is separability from the sabot.

7. The muzzle loaded ammunition round of claim 1 in which the bullet is positioned within a sabot and the sabot is engaged to the cartridge case.

8. The muzzle loaded ammunition round of claim 1 constructed and arranged to be penetrated by a breech block.

9. The muzzle loaded ammunition round of claim 1 further comprising an electrically conductive probe extending through the end of the cartridge case not facing the bullet.

10. The muzzle loaded ammunition round of claim 1 in which the propellant composition is one selected from the list consisting of: smokeless propellant, single base nitrocellulose, nitrocellulose propellant, black powder propellant, pyrotechnic propellant, non-pyrotechnic propellant, and any combination thereof.

11. The muzzle loaded ammunition round of claim 1 in which the propellant composition occupies a volume substantially equal to at least 90% of the volume of the cartridge case.

12. The muzzle loaded ammunition round of claim 1 in which the propellant composition includes at least one energy modifying material.

13. The muzzle loaded ammunition round of claim 12 in which the at least one energy modifying material is an energy reducing material.

14. The muzzle loaded ammunition round of claim 1 in which the propellant composition includes a pyrotechnic material.

15. The muzzle loaded ammunition round of claim 1 in which the propellant composition includes a stabilizer compound.

16. The muzzle loaded ammunition round of claim 15 in which the stabilizer compound is no greater than 1% by volume of the propellant composition.

* * * * *